US008292199B2

(12) United States Patent
Horn et al.

(10) Patent No.: US 8,292,199 B2
(45) Date of Patent: Oct. 23, 2012

(54) LOCKING ELEMENT FOR A DISPENSER

(75) Inventors: Michael Horn, Oldendorf (DE); Rudiger Belau, Bad Oldesloe (DE)

(73) Assignee: Lindal Ventil GmbH, Bad Oldesloe (DE)

( * ) Notice: Subject to any disclaimer, the term of this patent is extended or adjusted under 35 U.S.C. 154(b) by 918 days.

(21) Appl. No.: 11/605,044

(22) Filed: Nov. 28, 2006

(65) Prior Publication Data

US 2007/0125806 A1 Jun. 7, 2007

(30) Foreign Application Priority Data

Dec. 3, 2005 (DE) ..... 10 2005 057 822

(51) Int. Cl.
*B05B 1/32* (2006.01)
*B05B 9/04* (2006.01)
*F02M 61/20* (2006.01)

(52) U.S. Cl. ..... 239/453; 239/331; 239/533.9; 239/533.15; 239/571

(58) Field of Classification Search ..... 239/533.13, 239/533.15, 533.9, 537, 541, 569, 571, 576, 239/452, 453, 321.9, 380, 333, 487, 329, 239/331, 574, DIG. 12, 570, 572, 494–497, 239/511, 513, 514, 531, 546; 222/402.11, 222/494; 417/550; 251/337
See application file for complete search history.

(56) References Cited

U.S. PATENT DOCUMENTS

| | | | | |
|---|---|---|---|---|
| 3,754,690 | A * | 8/1973 | Marchant | 222/494 |
| 3,948,285 | A * | 4/1976 | Flynn | 137/494 |
| 4,182,496 | A * | 1/1980 | Burke | 239/492 |
| 5,746,414 | A * | 5/1998 | Weldon et al. | 251/149.6 |
| 5,992,764 | A * | 11/1999 | Bougamont et al. | 239/459 |
| 7,296,782 | B2 * | 11/2007 | Enerson et al. | 251/149.7 |

FOREIGN PATENT DOCUMENTS

| | | |
|---|---|---|
| DE | 44 44 399 | 7/1996 |
| DE | 203 07 819 | 9/2003 |

OTHER PUBLICATIONS

Abstract of Japanese Appln No. 05 133792, Rejection Head Structure Having Rejection Port-Automatically-Closing Mechanism . . . , filed Apr. 27, 1993.

* cited by examiner

*Primary Examiner* — Len Tran
*Assistant Examiner* — Justin Jonaitis
(74) *Attorney, Agent, or Firm* — Vidas, Arrett & Steinkraus, P.A.

(57) ABSTRACT

A locking element for a dispenser for discharging a medium, with an insert body, which has an outlet channel and an exit opening for the medium to be discharged, and a piston element which has a piston head co-operating with a piston seat and at least one elastic resilient leg, characterized in that a sealing element is arranged in the outlet channel, which forms the piston seat, and the piston element with the at least one resilient leg is arranged in an enlarging channel portion of the outlet channel, wherein the piston head is pre-tensioned against the piston seat and is pushed out of the piston seat by the exiting medium.

19 Claims, 1 Drawing Sheet

LOCKING ELEMENT FOR A DISPENSER

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention is related to a locking element for a dispenser. A dispenser may be a pressure reservoir provided with a release valve, in particular for discharging media such as gel, cream, paste and the like. The dispenser can also be realised as an elastic container, in which the medium is discharged upon compression. As the media, pasty, viscous, foam-forming and/or free-flowing media come into consideration.

DE 44 44 399 A1, the entire contents of which is incorporated herein by reference, describes a release head which prevents reboiling and drying of feed stock remaining in the socket after the actuation of the release valve. For this sake, the release head is constituted by an outer locking socket with a casing portion, which tapers in the direction towards a release opening. A shaft-shaped locking body is arranged movably in the casing portion, which is mounted in a pedestal portion of the locking socket by means of an elastic membrane. The release head is provided for a tiltable valve, in which a clearance inside the locking socket is filled with the medium and removes the locking body from the exit opening via the membrane.

From Patent Abstracts of Japan regarding JP 07052980, the entire contents of which is incorporated herein by reference, a locking system is known in which a shaft-shaped locking body is arranged in an exit opening of the locking system, too. The locking body has a membrane, which is held in the locking system. A chamber is filled by the exiting medium, so that a pressure is exerted on the membrane in order to retract the locking body from the exit opening.

From DE 20307819.5, the entire contents of which is incorporated herein by reference, a dispenser arrangement for a release valve has become known. The dispenser arrangement has an one-piece cap body made of plastic material, on the lower side of which an actuation portion is arranged, co-operating with the release valve of the pressurised package and having a channel. Further, a cup-shaped first insert body made of plastics is provided, which has a cylindrical perimeter wall which is insertable into a matching recess of the apron into the cap body. A second insert body with a ring-cylindrical section is further provided. The ring-cylindrical section is arranged between the perimeter wall of the first insert body and a stopper plane of the cap body. Further, the second insert body has a circular flexible membrane, which is formed on the front end of the ring-cylindrical section and has a pin which is formed on the front side of the membrane. Through the spring pre-tension of the membrane, the pin engages sealingly into the exit opening. A chamber is formed between the first and the second insert body, which is in continuous connection with the channel of the actuation section and is limited at one side by the membrane. The membrane is dimensioned such that upon actuation of the release valve, it is deformed towards the backside by the pressure in the chamber and thus it removes the pin from the exit opening.

When the pressure in the chamber tapers off, the second insert body is pushed forward into the exit opening again by the membrane.

The invention is based on the objective to provide a locking element which effectively prevents any after-flowing and drying on of the medium in the exit opening by simple means, particularly with pasty media.

BRIEF SUMMARY OF THE INVENTION

According to the invention, the locking element is dedicated to a dispenser, which is particularly suited for discharging pasty media. The locking element has an insert body and a piston element. The insert body has an outlet channel and an exit opening for the medium to be discharged. In the outlet channel, a sealing element is inserted in the region of the exit opening, which forms a circulating piston seat. The piston element has a piston head, co-operating with the piston seat, and at least one elastic resilient leg. According to the invention, the piston element runs in the outlet channel of the insert body, wherein the piston head is arranged in the outlet channel on the side pointing to the exit opening and the at least one resilient leg is arranged in an enlarging channel portion of the outlet channel. The piston element runs in the outlet channel through the sealing element and ends up preferably flush with the exit opening of the insert body. The piston head is sealingly pre-tensioned against the piston seat by the at least one resilient leg and is pushed out of the piston seat in the direction of the exit opening by exiting medium. In difference to the piston elements known in the state of the art, which close an exit opening, the piston element does not engage sealingly into the exit opening in the solution according to the invention, but instead it co-operates sealingly with a sealing element in the outlet channel which forms the piston seat. Further, the piston head is moved in the direction of the exit opening when the medium is to be exited. In contrary to this, solutions up to now are intending to retract the piston element from the exit opening in the outlet channel.

In a preferred embodiment of the locking element according to the invention, the insert body has a substantially cylindrical shape, in which the outlet channel extends along the longitudinal axis of the cylinder. The outlet channel has a constant diameter in a first channel section, which runs out into the exit opening. In a possible form of realisation, the sealing element is inserted into the first channel section. In a preferred embodiment, sealing element and insert body are formed in one piece. In order to do this, a two-component injection moulding process is preferably used, the sealing element being made from a soft, well-tightening material. The piston seat is preferably formed by an inner wall of the sealing element, which co-operates with the piston head along its perimeter. Preferably, the sealing element forming the piston seat is made from a soft material.

In a preferred embodiment, the insert body is inserted into the dispenser in a recess, wherein the channel of the dispenser for the medium to be discharged runs out into the outlet channel. The insert body is preferably held in a press fit in the recess. Thus, the insert body with the outlet channel forms the exit opening for the medium in this embodiment, the insert body preferably projecting from an apron of the dispenser.

The piston head has a cone-shaped intermediate section, which runs out into a cylindrical shaft. The outer diameter of the shaft is smaller than the inner diameter of the piston seat. On the end opposite to the piston head, the shaft has at least one elastic resilient leg. Preferably, two, three or four resilient legs are provided on the piston element. The resilient legs stand away from the shaft at an angle pointing away from the piston head, each resilient leg having a kinked section at its free end, which clings substantially even to the conical inner wall in the outlet channel. The resilient legs are dimensioned such that the restoring force produced by them pushes the piston head sealingly into the piston seat and the piston head can be pushed out of the piston seat by the medium which is to be discharged.

In one possible embodiment, the dispenser is a pressure reservoir provided with a release valve. The valve is actuated via a spraying cap. The actuation section of the spraying cap projects into the inner space, the channel of the spraying cap extending centrally along a central longitudinal axis of the spraying cap from an entrance opening and being kinked about 90°. The actuation element has preferably an opening in the side wall near the entrance opening, through which the medium to be discharged enters from the valve into the channel.

In an alternative embodiment, the dispenser is realised as an elastic container, which discharges the medium when its container wall is compressed. In this, it may be dealt with a bottle with elastic walls, for example.

The piston element with its elastic resilient legs is preferably made of an acetal copolymer (POM). For improved sealing, the piston seat is made from an elastomer which is softer than the acetal copolymer of the piston element, in particular when the insert body in the locking cap does not have a 100% circular form or is deformed during insertion. Alternatively, it is also possible to manufacture the piston head with its transition plane from a soft elastomer, the insert body completely consisting of POM in this case. Also, two additional sealing parts from a soft elastomer can be provided.

BRIEF DESCRIPTION OF THE SEVERAL VIEWS OF THE DRAWINGS

A preferred embodiment of a spraying cap with the locking element according to the invention will be explained hereinafter by means of the figures.

DETAILED DESCRIPTION OF THE INVENTION

Figure 1:
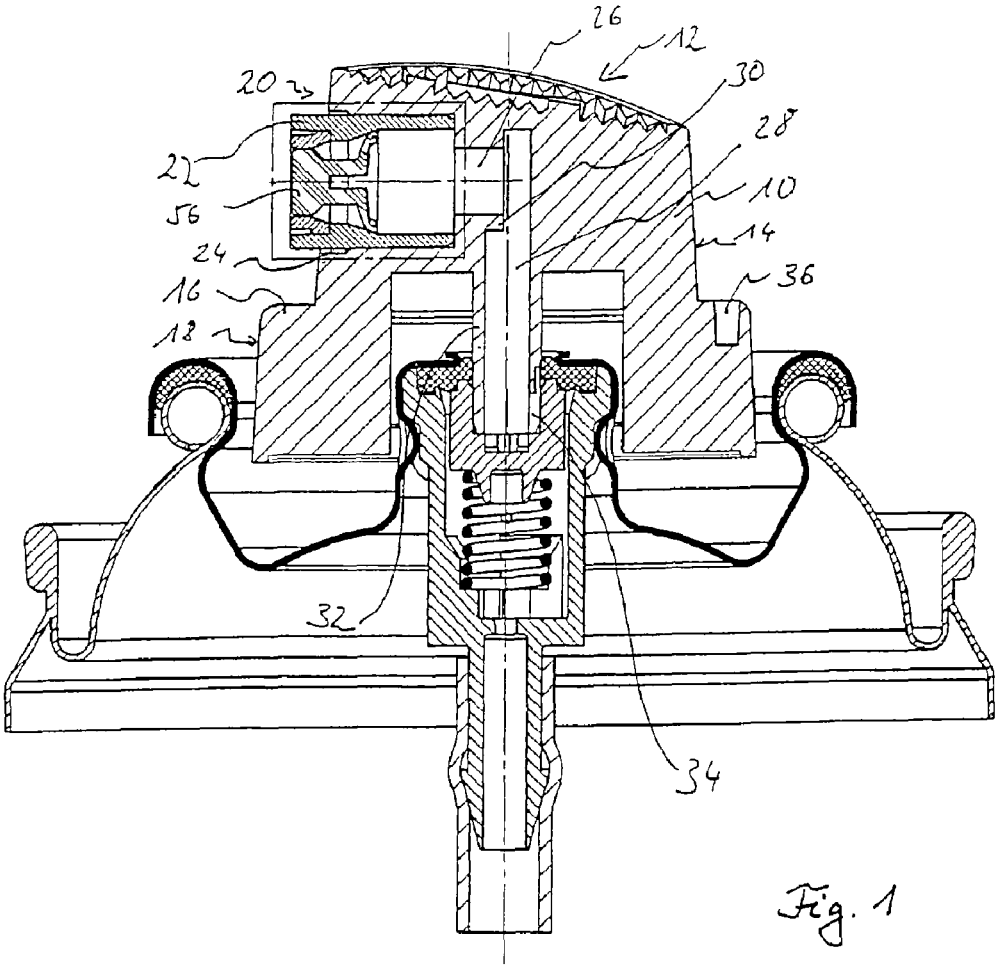
FIG. 1 shows a cross section through the spraying cap which is set up on a valve.

While this invention may be embodied in many different forms, there are described in detail herein a specific preferred embodiment of the invention. This description is an exemplification of the principles of the invention and is not intended to limit the invention to the particular embodiment illustrated FIG. 1 shows a one-piece spraying cap 10 of plastic material. The spraying cap 10 has a corrugated pressing field 12 on its upper side, and a substantially cylindrically revolving outer wall 14. Via a revolving shoulder 16 follows a second revolving wall section 18, which as greater perimeter than the upper wall section.

The spraying cap 10 has a cylindrical recess 20, which accommodates the insert body 22. The recess 20 has a revolving deepening 24, which simplifies the insertion of the insert body 22. On the bottom of the recess 20, the channel section 26 runs out, which extends to the spraying cap 10 in the radial direction. The channel section 26 is connected with the channel 28, which runs in the centre of the spraying cap 10 along the central longitudinal axis. From FIG. 1 it can be recognised that the kinked channel section 26 has a significantly greater diameter than the channel section 28. In FIG. 1 it can be also recognised that the channel section 26 projects into the channel section 28 in a region 30 and reduces the diameter in the channel section 28 in the region of transition of the section 26.

The cylindrical wall 32 of the channel section 28 has an opening 34 on its free end.

On the side opposite to the recess 20, the shoulder 16 is provided with an U-shaped deepening 36.

On the end pointing to the valve, the spraying cap 10 has a revolving brim, which is strengthened by a shoulder 38. Further, ribs 40 are provided in the spraying cap 10, which project radially towards the inside in the spraying cap 10 and form an abutment edge 42 for the dome of the valve.

The locking element according to the invention has an insert body 22 with a cylindrical outer wall and an outlet channel extending in the longitudinal direction. The outlet channel has a first cylindrical channel section 44, which runs out into the exit opening 46. As is represented in FIG. 1, the insert body 22 projects from the recess 20 and the apron wall 14. In the first channel section 44, a sealing element 48 is formed, which forms the piston seat. In the represented example of realisation, the sealing element 48 is formed from a second material by a 2-component injection moulding process. In contrast to a hard POM-material, a soft elastomer is used for the sealing element. The sealing element 48 has seat region 49, which rests on a projecting shoulder 50 in the outlet channel. Further, the sealing element 48 has a sealing lip 53, the inner wall of which forms the piston seat. The revolving sealing lip 53 has an outer diameter which is smaller than the inside diameter of the first channel section and which is also smaller than the outer diameter of the seat region 49. Even the inside diameter of the sealing lip is smaller than the conically enlarging inside diameter of the outlet channel. The inner wall of the sealing lips has rounded edges. The sealing lips cling springably to the piston head and thus form the piston seat.

The shoulder 56 is followed by a channel section 51, the diameter of which enlarges conically. On its end pointing away from the sealing element 48, the conically enlarging channel section 51 verges into a cylindrical section 52. The outer wall of the insert body 22 has a bevelled revolving edge 54, which co-operates with the deepening 24 of the recess 20 at the insertion.

Figure 2:
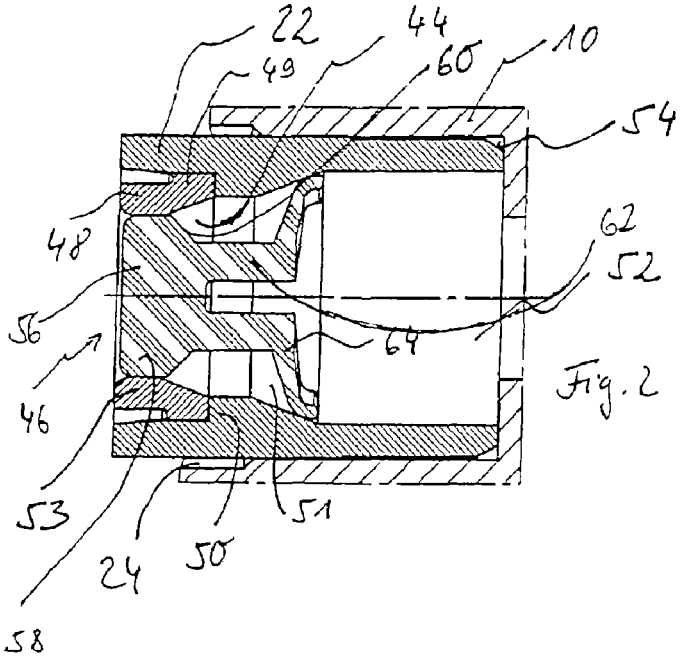
FIG. 2 shows the insert body of FIG. 1.

Further, the piston element 56 is represented in FIG. 2. The piston element 56 has a cylindrical piston head 58 with a cone-shaped plane of transition 60. The piston head 58 with its plane of transition 60 is followed by the shaft 62. The shaft 62 has resilient legs 64 which stand away with respect to the piston head 58. Two telescopic resilient legs 64 are visible in the cross section represented in FIG. 2. In contrast to known solutions, the medium enters the conical section of the outlet channel between the resilient legs in the solution according to the invention. In doing so, a force is exerted on the shaft as well as on the plane of transition 60 of the valve head, which push the piston element in the direction of the exit opening 46.

In the actuation, a force with a component in the longitudinal direction is exerted on the pressure plane 12. A force is exerted on a valve 68 via the channel wall 32. In FIG. 1, the valve 68 is represented as a female valve only for the sake of exemplification. It is also possible to realise the actuation section of the spraying cap for a male valve.

Upon pressure, the valve opens, the medium exits from the container into the channel 28 and there it is deflected into the kinked channel section 26. By the pressure of the medium, the piston head 58 is pressed out of the rest on the sealing element against the force of the resilient legs 64.

When the pressure on the pressure field 12 decreases, the valve closes and the piston element 56 is no longer pressed out of the piston seat. Through the action of the resilient legs, the piston head 58 returns into its sealing position. Reboiling and drying on of the exited medium is effectively prevented in this manner. Through the flush arrangement of the piston head, residues from the actuation in the region of the exit opening are avoided.

The described locking element can be used in every kind of dispensers for the discharge of a medium. The locking element is suitable for pressure reservoirs with valve as well as for containers that are to be squeezed manually. For the use, it is only necessary that no pressure is present on the piston in the non-operative condition and that the medium leaves the outlet channel under a certain pressure when exiting. This pressure must be greater than the restoring force exerted by the resilient legs.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A Locking element for a dispenser for discharging a medium comprising:

an insert body (22), which has an outlet channel (44, 51, 52) and an exit opening (46) for the medium to be discharged, the insert body having a first cylindrical channel section (44) which runs into the exit opening at one end and a projecting shoulder (50) on the other end, the shoulder (50) is followed by a channel section (51) having a diameter that is constant for a portion and is followed by a conically enlarging channel section, the conically enlarging channel section verges into a cylindrical section (52);

a sealing element (48) that includes a seat region (49) sized to fit within the first cylindrical section of the insert body and resting against the shoulder;

a piston element (56), sized to fit within the insert body, and having a piston head (58) and at least two elastic resilient legs (64) which extend radially outward and away from the piston head opposite of the direction of flow of the exiting medium, the piston head cooperating with the seat region of the sealing element to form a seal and flush with the exit opening when in a sealing position, and the resilient legs arranged in the enlarging channel portion of the outlet channel;

wherein the piston head is pre-tensioned against the piston seat by the at least two elastic resilient legs and is pressed out of the seat region of the sealing element by and in the direction of the flow of the exiting medium to an open position against the force of the resilient legs.

2. A locking element according to claim 1, characterised in that the insert body (22) has a substantially cylindrical shape and that the outlet channel extends along the longitudinal axis of the cylinder.

3. A locking element according to claim 2, characterised in that the outlet channel has a first channel section (51) with a constant diameter, which runs out into the exit opening (46).

4. A locking element according to claim 3, characterised in that the sealing element (48) is inserted into the first channel section.

5. A locking element according to claim 3, characterised in that the sealing element (48) is formed in one piece with the insert body (22).

6. A locking element according to claim 5, characterised in that the insert body with the sealing element is manufactured using the 2-component injection moulding process.

7. A locking element according to claim 1, characterised in that the sealing element is made from a soft material.

8. A locking element according to claim 1, characterised in that the insert body is set into a recess (20) in the dispenser, wherein a channel of the dispenser (26) for the medium to be discharged runs out into the outlet channel of the insert body.

9. A locking element according to claim 8, characterised in that the insert body (22) is held in a press fit in the recess (20).

10. A locking element according to claim 1, characterised in that the piston head (58) has a substantially cylindrical form with a cone-shaped plane of transition (60) to a cylindrical shaft (62).

11. A locking element according to claim 1, characterised in that the piston head fits closely to the piston seat in the sealing element along its perimeter.

12. A locking element according to claim 11, characterised in that the piston head is springably arranged in the sealing element.

13. A locking element according to claim 1, characterised in that the at least two resilient legs (64) are arranged on a shaft (62).

14. A locking element according to claim 1, characterised in that the at least two resilient legs are comprised of two, three or four resilient legs (64) which extend away from the piston element.

15. A locking element according to claim 1, characterised in that the dispenser has an elastic container, which presses out its medium when it is compressed from the outside.

16. A locking element according to claim 1, characterised in that the dispenser has a pressure reservoir which is provided with a release valve (68).

17. A locking element according to claim 16, characterised in that each resilient leg (64) has a kinked section (66) on its free end, which clings substantially even to the inner wall in the outlet channel (50).

18. A locking element according to claim 1, characterised in that the piston element is made from an acetal copolymer (POM).

19. A locking element according to claim 1, characterised in that the sealing element and/or the piston seat is made from an elastomer which is softer than the acetal copolymer of the piston element.

* * * * *